US007340916B2

(12) United States Patent
Kim

(10) Patent No.: US 7,340,916 B2
(45) Date of Patent: Mar. 11, 2008

(54) PRESSURE EQUALIZING DEVICE FOR REFRIGERATORS

(76) Inventor: Brian S. Kim, 7004 Calle Del Pajarito, Rancho Palos Verdes, CA (US) 90275

( * ) Notice: Subject to any disclaimer, the term of this patent is extended or adjusted under 35 U.S.C. 154(b) by 272 days.

(21) Appl. No.: 11/281,829

(22) Filed: Nov. 17, 2005

(65) Prior Publication Data

US 2007/0107458 A1 May 17, 2007

(51) Int. Cl.
*F25D 17/00* (2006.01)
*F25D 11/00* (2006.01)

(52) U.S. Cl. ..... 62/409; 62/440

(58) Field of Classification Search ..... 62/151, 62/234, 272, 273, 409, 410, 440, 441; 137/526; 220/231; 312/405, 406.1
See application file for complete search history.

(56) References Cited

U.S. PATENT DOCUMENTS 2,787,030 A * 4/1957 Williams ..... 49/317
2,810,493 A * 10/1957 Eichhorn et al. ..... 220/231
3,311,045 A * 3/1967 Costantini et al. ..... 454/183
3,587,242 A * 6/1971 Amran ..... 62/77
3,916,643 A * 11/1975 Brown ..... 62/410
4,569,208 A * 2/1986 Villa ..... 62/273
5,557,942 A * 9/1996 Kim et al. ..... 62/288
5,573,323 A * 11/1996 Kim et al. ..... 312/405
5,836,170 A * 11/1998 Perkins et al. ..... 62/409
6,176,776 B1 * 1/2001 Finkelstein et al. ..... 454/195
6,374,620 B1 * 4/2002 Markey ..... 62/89
6,672,094 B1 * 1/2004 Carden et al. ..... 62/273
7,107,780 B2 * 9/2006 Bellini et al. ..... 62/273

FOREIGN PATENT DOCUMENTS

JP 7-190602 A * 7/1995

* cited by examiner

*Primary Examiner*—Mohammad M. Ali
(74) *Attorney, Agent, or Firm*—John K. Park; Park Law Firm

(57) ABSTRACT

A pressure equalizing device for refrigerators, having a chamber, a door on the front wall of the chamber, an evaporator, and an evaporator defrost heater, is provided. The pressure equalizing device includes a pressure relief valve, an installation hole, and a deicing device for the pressure relief valve. The pressure relief valve connects the inside and outside of the chamber, and includes an inner end and an outer end. The installation hole is perforated on one of the walls of the chamber. The pressure relief valve equalizes the pressure inside and outside of the chamber to facilitate the opening of the door. The pressure relief valve includes an operation switch, and the operation switch is activated by the opening of the door. The pressure relief valve is disposed over deicing device, and the deicing device melts ice formed on the inner end of the pressure relief valve.

18 Claims, 4 Drawing Sheets

PRESSURE EQUALIZING DEVICE FOR REFRIGERATORS

BACKGROUND OF THE INVENTION

The present invention relates to a pressure equalizing device for refrigerators. More particularly, this invention relates to a pressure equalizing device for refrigerators, which facilitates the opening of the doors of refrigerators.

Definitely, a refrigerator is an unmistakable achievement of science and technology. It is a cool result of the intensive research in thermodynamics, electric engineering, and material engineering such as heat pump, thermal expansion, latent heat, and the like.

One of the most well-known physical phenomena in cooling is the thermal contraction. When cooled down, the objects contract. It holds true to everything existent; solid, liquid, and even gas.

Refrigerator is a device to cool down the inside of a chamber that is thermally insulated from the outside. That means that everything in the chamber experiences thermal contraction. The air trapped in the chamber cannot be exceptional. It contracts under the cooling condition of the refrigerator.

When the door is open, the chamber gets filled with air from the outside, that is, warm air. If the door is closed and remains closed, the trapped air cools down and contracts. The cooled down and contracted air inside the chamber with a fixed volume brings about lower air pressure compared to that outside.

Then, the air pressure difference between the inside and outside of the chamber expresses itself as a force holding the door from opening.

The situation gets worse with the volume of air trapped in the chamber. Even with a refrigerator having a small volume of chamber, it happens when the temperature difference between the inside and outside of the chamber is very large.

A walk-in refrigerator is not uncommon in many industries. Considering the vast volume of chamber, the holding force of the door must be very demanding.

Accordingly, a need for a pressure equalizing device for refrigerators has been present for a long time considering the tendency of growing in size of refrigerator. This invention is directed to solve these problems and satisfy the long-felt need.

SUMMARY OF THE INVENTION

The present invention contrives to solve the disadvantages of the prior art.

An object of the invention is to provide a pressure equalizing device for refrigerators.

Another object of the invention is to provide a pressure equalizing device that facilitates the opening of the refrigerators.

Still another object of the invention is to provide a pressure equalizing device for refrigerators, which removes ice formed at one end of the pressure relief valve.

Still another object of the invention is to provide a pressure equalizing device for refrigerators, which removes the melted water out to a drain pan.

A pressure equalizing device is installed on the top of the refrigerator. The refrigerator has 1) a chamber enclosed by front, rear, right, left, top, and bottom walls defining inside and outside; 2) a door on the front wall of the chamber; 3) an evaporator; and 4) an evaporator defrost heater, is provided.

The pressure equalizing device includes a pressure relief valve, an installation hole, and a deicing device for the pressure relief valve.

The pressure relief valve connects the inside and outside of the chamber, and includes an inner end and an outer end.

The installation hole is perforated on one of the walls of the chamber.

The pressure relief valve equalizes the pressure inside and outside of the chamber to facilitate the opening of the door.

The pressure relief valve includes an operation switch, and the operation switch is activated by the opening of the door.

The pressure relief valve is disposed over deicing device, and the deicing device melts ice formed on the inner end of the pressure relief valve. The deicing device operates periodically. For example, the deicing device operates in a predetermined period of time after closing the door of the chamber.

The pressure relief valve is disposed over the evaporator defrost heater. The pressure equalizing device further includes a drain pan, and the drain pan is disposed below the evaporator defrost heater. The melted water from the pressure relief valve drops into the drain pan.

The pressure relief valve is installed in the installation hole, and the installation hole is perforated at the door. The pressure relief valve is buried and installed in the door.

The pressure relief valve is installed in the installation hole, and the installation hole is perforated through the top wall of the chamber above the evaporator defrost heater.

The pressure relief valve is detachably fixed on the installation hole, and the pressure relief valve protrudes over the installation hole. The evaporator defrost heater is operated with a predetermined interval. The predetermined interval includes, for example, eight (8) hours.

The pressure equalization device further includes a lid, an outer protection cover, and an inner protection cover. The lid fits in the installation hole, and covers the installation hole with the pressure relief valve detached for storing or carrying of the refrigerator. The outer protection cover is for protecting the outer end of the pressure relief valve, and the inner protection cover is for protecting the inner end of the pressure relief valve. The lid includes a rubber cover.

The pressure equalization device further includes a seal between the inner side of the pressure relief valve and the outer surface of the chamber. The seal has a thickness from about eight (8) millimeters to about twelve (12) millimeters.

The deicing device is adapted to keep the inner end of the pressure relief valve over zero (0) degree in Celsius.

The advantages of the present invention are: (1) the pressure equalization device is very useful to facilitate to open doors for refrigerator; (2) the pressure equalization device is especially effective in the large scale refrigerators such as a walk-in refrigerator; and (3) the pressure equalization device works properly even in an atmosphere of high humidity.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
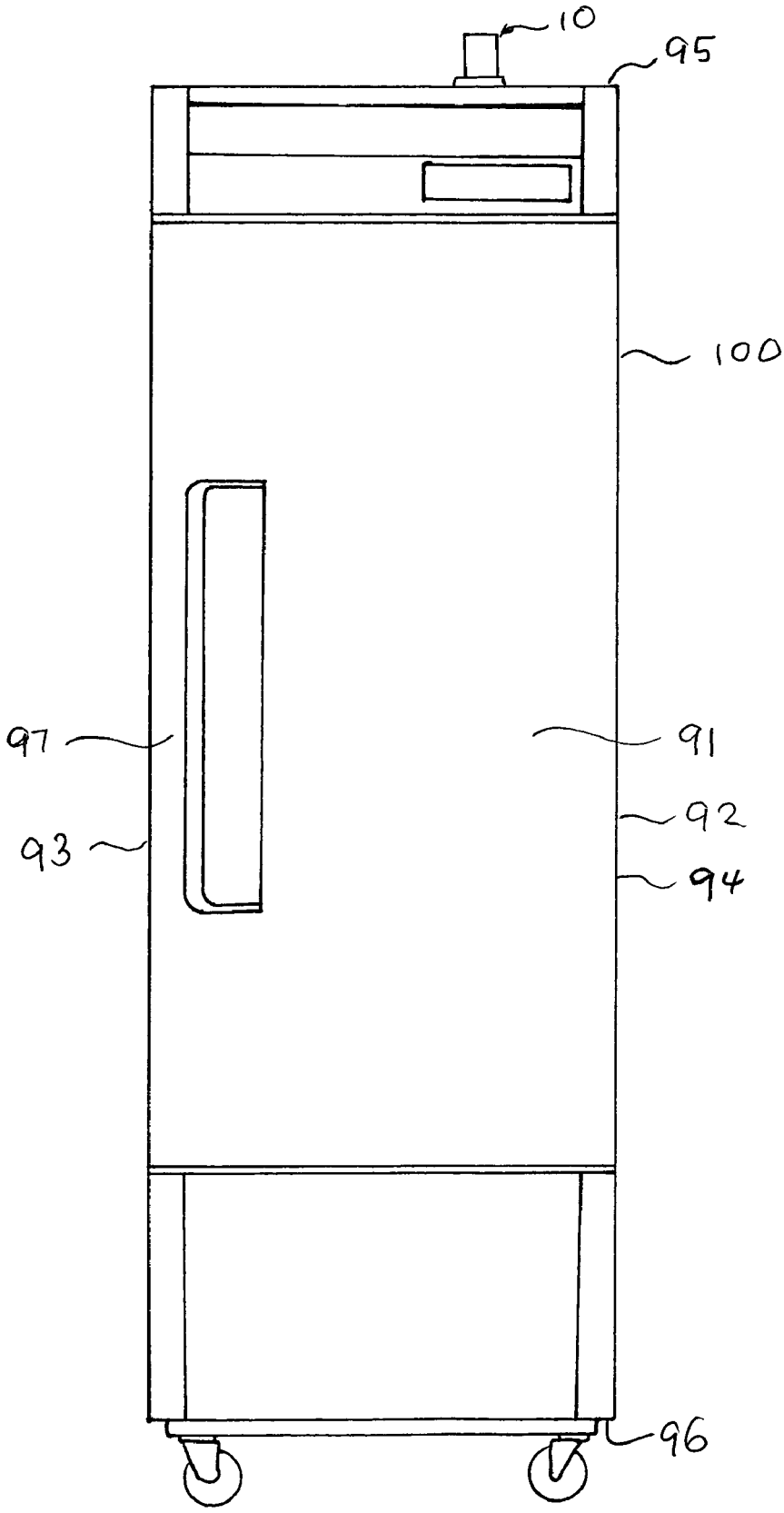
FIG. 1 is a perspective view showing a refrigerator with a pressure equalizing device installed.
Figure 2:
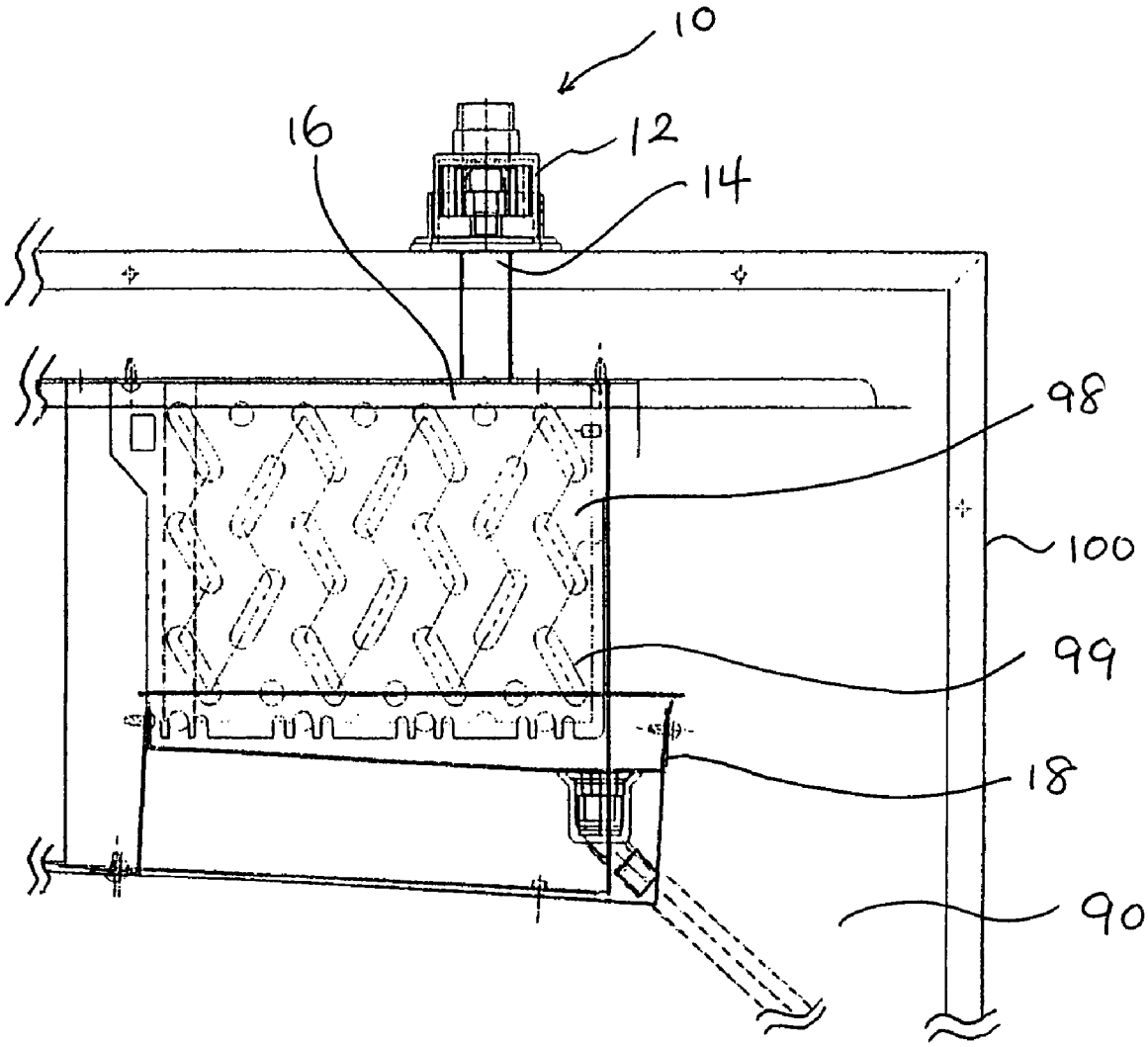
FIG. 2 is a part of cross-sectional view of the refrigerator around the pressure equalizing device of FIG. 1.

FIG. 1 and FIG. 2 show a refrigerator 100 with a pressure equalizing device 10 installed.

The pressure equalizing device 10 is installed on the top of the refrigerators 100. The refrigerator 100 has 1) a chamber 90 enclosed by front, rear, right, left, top, and bottom walls 91, 92, 93, 94, 95, 96 respectively defining inside and outside; 2) a door 97 on the front wall 91 of the chamber 90; 3) an evaporator 98; and 4) an evaporator defrost heater 99, is provided.

The pressure equalizing device 10 includes a pressure relief valve 12, an installation hole 14, and a deicing device 16 for the pressure relief valve 12.

Figure 3:
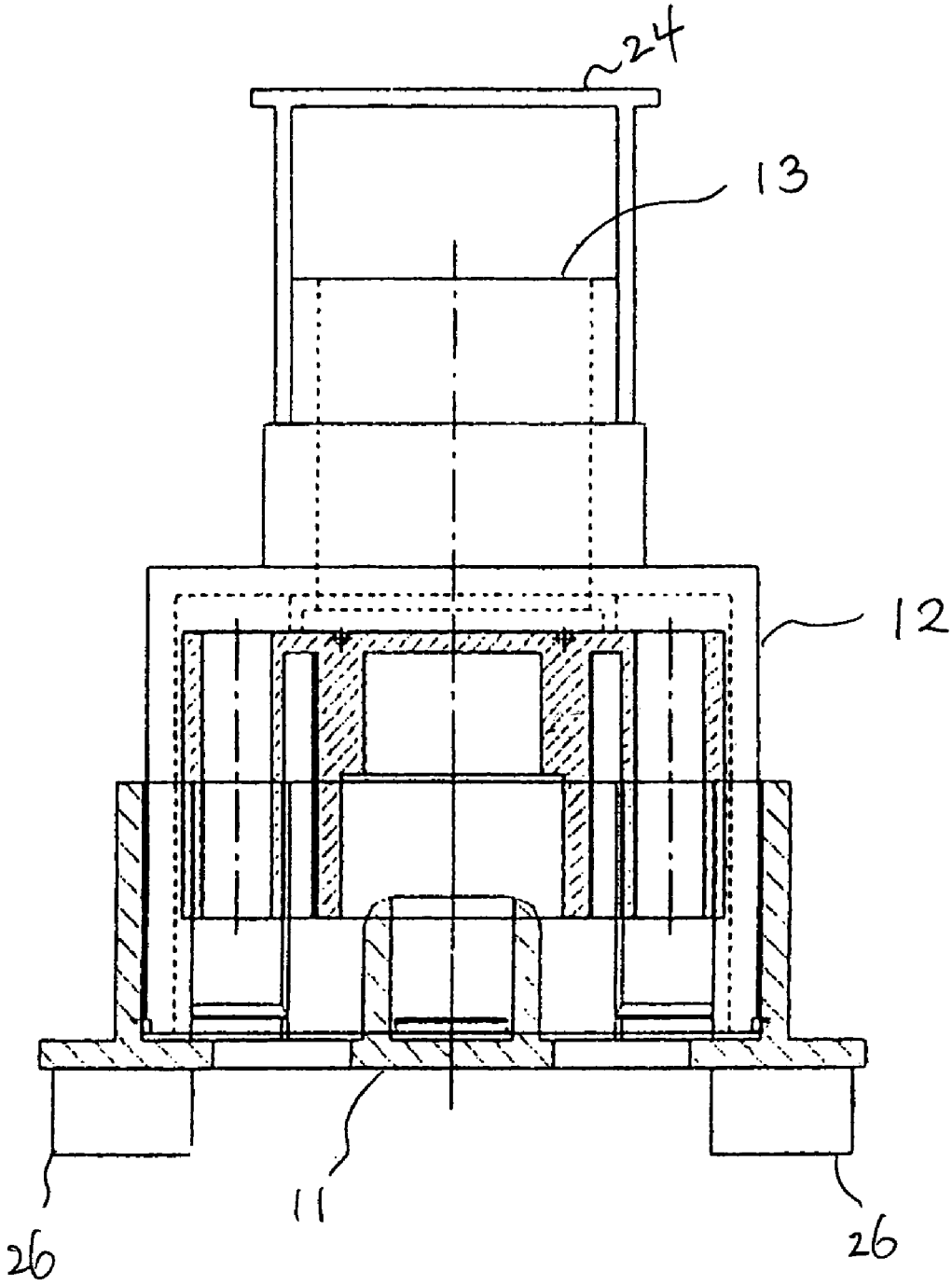
FIG. 3 is a cross-sectional view of a pressure relief valve.

The pressure relief valve 12 connects the inside and outside of the chamber 90, and includes an inner end 11 and an outer end 13 as shown in FIG. 3.

The installation hole 14 is perforated on one of the walls 91 through 96 of the chamber 90.

The pressure relief valve 12 equalizes the pressure inside and outside of the chamber 90 to facilitate the opening of the door 97.

The pressure relief valve 12 includes an operation switch (not shown), and the operation switch is activated by the opening of the door 97. The operation switch can be disposed in the door handle, and the operation pressure relief valve 12 is able to be operated by sensing the squeeze of the door handle, for instance.

The pressure relief valve 12 is disposed over deicing device 16, and the deicing device 16 melts ice formed on the inner end 11 of the pressure relief valve 12. The deicing device 16 operates periodically. For example, the deicing device 16 operates in a predetermined period of time after closing the door of the chamber 90.

The pressure relief valve 12 is disposed over the evaporator defrost heater 99. The pressure equalizing device 10 further includes a drain pan 18, and the drain pan 18 is disposed below the evaporator defrost heater 99. The melted water from the pressure relief valve 12 drops into the drain pan 18.

In an embodiment of the invention (not shown), the pressure relief valve 12 is installed in the installation hole 14, and the installation hole 14 is perforated at the door 97. The pressure relief valve 12 is buried and installed in the door 97.

Figure 5:
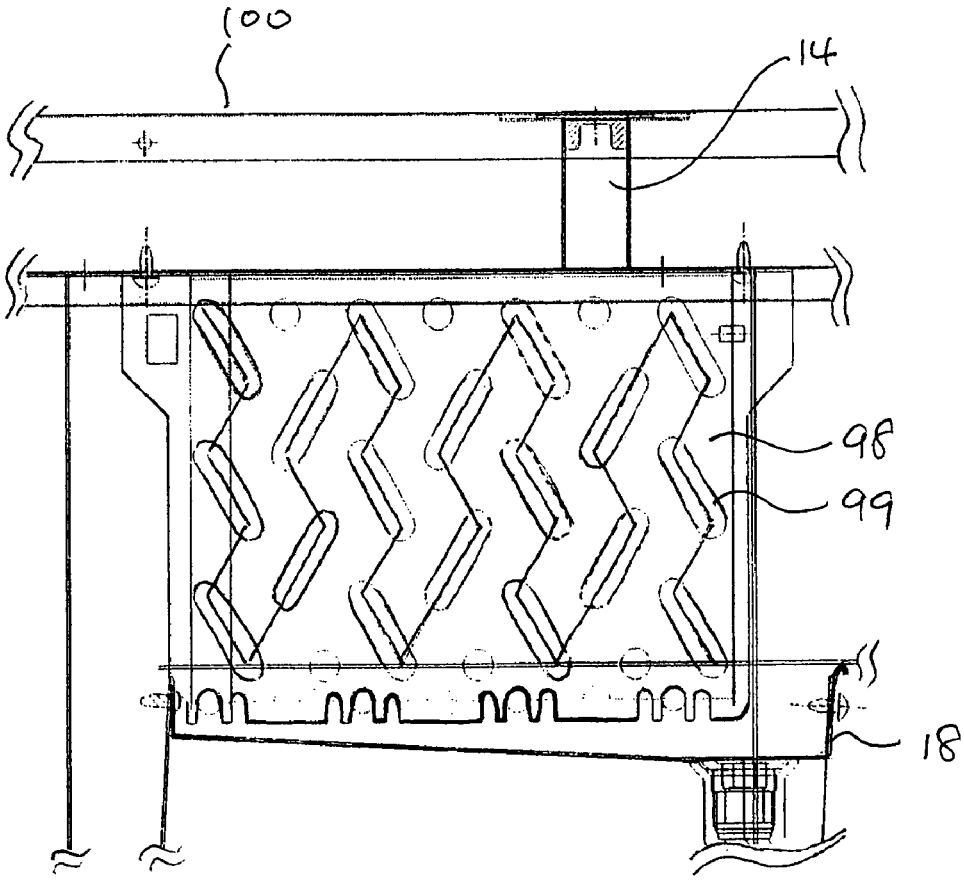
FIG. 5 is a part of cross-sectional view of the refrigerator with the lid for installation hole.

In another embodiment of the invention (refer to FIG. 1, FIG. 2, and FIG. 5, the pressure relief valve 12 is installed in the installation hole 14, and the installation hole 14 is perforated through the top wall 95 of the chamber 90 above the evaporator defrost heater 99.

The pressure relief valve 12 is detachably fixed on the installation hole 14, and the pressure relief valve 12 protrudes over the installation hole 14. The evaporator defrost heater 99 is operated with a predetermined interval. The predetermined interval includes, for example, eight (8) hours.

Figure 4:
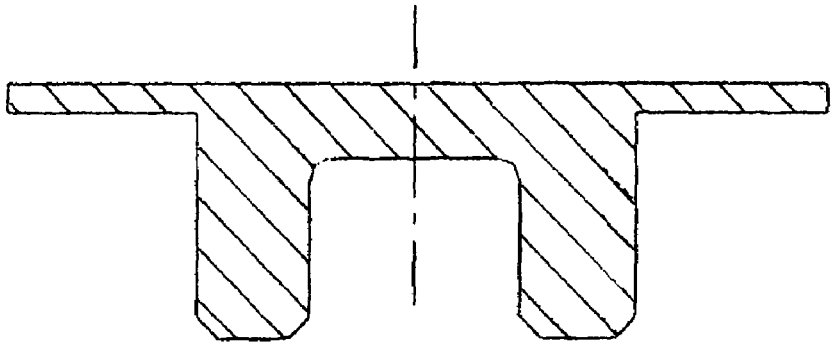
FIG. 4 is a cross-sectional view of a lid for installation hole.

With the pressure installation device 10 on the top of the refrigerator 100 as shown in FIG. 1 and FIG. 2, it is not going to possible to stack the refrigerators 100 in warehouse. For the purpose, the pressure relief device 12 should be able to be detached from the refrigerator 100 as shown in FIG. 5. Therefore, the pressure equalization device 10 further includes a lid 22 (refer to FIG. 4), an outer protection cover 24, and an inner protection cover (not shown) as shown in FIG. 5. The outer protection cover 24 and an inner protection cover are for protecting the pressure relief valve 12. The lid 22 fits in the installation hole 14 as shown in FIG. 5, and covers the installation hole 14 with the pressure relief valve 12 detached for storing or carrying of the refrigerator 100. The outer protection cover 24 is for protecting the outer end 13 of the pressure relief valve 12, and the inner protection cover (not shown) is for protecting the inner end 11 of the pressure relief valve 12. The lid 24 includes a rubber cover.

The pressure equalization device 10 further includes a seal 26 between the inner side 11 of the pressure relief valve 12 and the outer surface of the chamber 90. The seal 26 has a thickness from about eight (8) millimeters to about twelve (12) millimeters.

The deicing device 16 is adapted to keep the inner end 11 of the pressure relief valve 12 over zero (0) degree in Celsius. The evaporator defrost heater 99 can be adapted to work as a deicing device 16.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A pressure equalizing device for refrigerators having:

1) a chamber enclosed by front, rear, right, left, top, and bottom walls defining inside and outside;

2) a door on the front wall of the chamber;

3) an evaporator; and 4) an evaporator defrost heater, comprising:

a) a pressure relief valve, connecting the inside and outside of the chamber, comprising an inner end and an outer end;

b) an installation hole perforated on one of the walls of the chamber; and c) a deicing device for the pressure relief valve, wherein the pressure relief valve equalizes the pressure inside and outside of the chamber to facilitate the opening of the door.

2. The pressure equalizing device of claim 1, wherein the pressure relief valve comprises an operation switch, wherein the operation switch is activated by the opening of the door.

3. The pressure equalizing device of claim 1, wherein the pressure relief valve is disposed over deicing device, wherein the deicing device melts ice formed on the inner end of the pressure relief valve.

4. The pressure equalizing device of claim 3, wherein the deicing device operates periodically.

5. The pressure equalizing device of claim 3, wherein the deicing device operates in a predetermined period of time after closing the door of the chamber.

6. The pressure equalizing device of claim 1, wherein the pressure relief valve is disposed over the evaporator defrost heater.

7. The pressure equalizing device of claim 6, further comprising a drain pan, wherein the drain pan is disposed below the evaporator defrost heater, wherein the melted water from the pressure relief valve drops into the drain pan.

8. The pressure equalizing device of claim 1, wherein the pressure relief valve is installed in the installation hole, wherein the installation hole is perforated at the door.

9. The pressure equalization device of claim 8, wherein the pressure relief valve is buried and installed in the door.

10. The pressure equalizing device of claim 1, wherein the pressure relief valve is installed in the installation hole, wherein the installation hole is perforated through the top wall of the chamber above the evaporator defrost heater.

11. The pressure equalizing device of claim 10, wherein the pressure relief valve is detachably fixed on the installation hole, wherein the pressure relief valve protrudes over the installation hole.

12. The pressure equalization device of claim 11, wherein the evaporator defrost heater is operated with a predetermined interval.

13. The pressure equalization device of claim 12, wherein the predetermined interval comprises eight (8) hours.

14. The pressure equalization device of claim 11, further comprising:

a) a lid fit in the installation hole, wherein the lid covers the installation hole with the pressure relief valve detached for storing or carrying of the refrigerator;

b) an outer protection cover for protecting the outer end of the pressure relief valve; and c) an inner protection cover for protecting the inner end of the pressure relief valve.

15. The pressure equalization device of claim 14, wherein the lid comprises a rubber cover.

16. The pressure equalization device of claim 10, further comprising a seal between the inner side of the pressure relief valve and the outer surface of the chamber.

17. The pressure equalization device of claim 16, wherein the seal has a thickness from about eight (8) millimeters to about twelve (12) millimeters.

18. The pressure equalization device of claim 1, wherein the deicing device is adapted to keep the inner end of the pressure relief valve over zero (0) degree in Celsius.

* * * * *